US005255457A

United States Patent [19]

Lipson

[11] Patent Number: 5,255,457

[45] Date of Patent: Oct. 26, 1993

[54] FIGURINE PICTURE FRAME

[76] Inventor: Erik Lipson, 213 S. Bonsall St., Philadelphia, Pa. 19103

[21] Appl. No.: 789,598

[22] Filed: Nov. 8, 1991

[51] Int. Cl.[5] ..... A47G 1/06

[52] U.S. Cl. ..... 40/152.1; 446/268; 446/374

[58] Field of Search ..... 40/152, 152.1, 153, 40/154, 538, 606; 446/268, 385, 374, 391

[56] References Cited

U.S. PATENT DOCUMENTS

| | | | |
|---|---|---|---|
| 1,422,840 | 7/1922 | Fould | 446/374 |
| 1,450,821 | 4/1923 | Schutz | 40/152.1 |
| 1,591,661 | 7/1926 | Dinsdale | 446/374 |
| 1,750,894 | 3/1930 | Kramer | 40/152.1 |
| 2,749,636 | 6/1956 | Viglietta | 40/152 |
| 3,395,484 | 8/1968 | Smith | 446/374 |
| 3,593,455 | 7/1991 | Farris | 446/385 |
| 4,020,586 | 5/1977 | Benner | 446/391 X |

FOREIGN PATENT DOCUMENTS

| | | | |
|---|---|---|---|
| 0867386 | 5/1961 | United Kingdom | 446/385 |

*Primary Examiner*—Kenneth J. Dorner
*Assistant Examiner*—Milton Nelson, Jr.
*Attorney, Agent, or Firm*—Krass & Young

[57] ABSTRACT

A figurine picture frame in the shape of a mammal having a body portion with a head portion positioned relative to the body portion and supported thereby, the head portion being configured to receive and support a picture for display.

10 Claims, 2 Drawing Sheets 16
20
24b
48b
24a
48a 18
22
28
26b
48d
26a
48c 10
14
16
30
24b
28
48b
26b
7
5
32
18
48a
24a
12
26a 40
48b
34
5
20
16
24b
12
26b
48d
32
14
18
10
24a
28
48a
26a
48c

FIGURINE PICTURE FRAME

BACKGROUND OF THE INVENTION

1. Field of the Invention

This invention relates generally to the field of picture frames and more particularly to a figurine picture frame in the shape of a mammal having a body portion and a head portion wherein the head portion is adapted to support and display a picture.

2. Description of the Related Prior Art

A wide variety of picture frames and figurines are disclosed in the prior art. It is common practice to personalize and enhance both home and office space through the use of framed pictures or photographs. Likewise, it is known to use figurines depicting humans or animals to decorate a room. Often, these figurines depict an occupation, characteristics, or interests of either the person displaying the figurine or their relatives or friends. Where space permits, groupings of picture frames and figurines are positioned and arranged on desk tops, book shelves, tables or the like for display and decoration. Where space is limited, yet decoration is still desired, it would be convenient to have a combination figurine picture frame.

SUMMARY OF THE INVENTION

Disclosed and claimed herein is a combination figurine picture frame which eliminates the need for separate picture frames and figurines and saves space in an aesthetically-pleasing manner. The figurine of the present invention is shaped to represent a mammal having a body portion and a head portion. The head portion includes a front section having a peripheral framing member lying in substantially a single plane, and a back section supported behind and adjacent to the front section. Together, the front and back sections of the head portion are adapted to engage the opposite sides of a picture so that the picture is supported and displayed within the head portion of the figurine. By inserting a picture or photograph of a face in the head portion of the figurine, the face in the photograph becomes the face of the figurine, thus bringing the figurine "to life." Although it is preferable for maximum overall effect that the photograph inserted into the figurine picture frame be of a face, it is obvious that any picture may be inserted at the user's discretion. Prior art picture frames, unlike the present invention, are not configured in the shape of a mammal figurine having a body portion and a head portion with the head portion specifically designed to display a picture.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figures 1, 2, 3A, 3B:
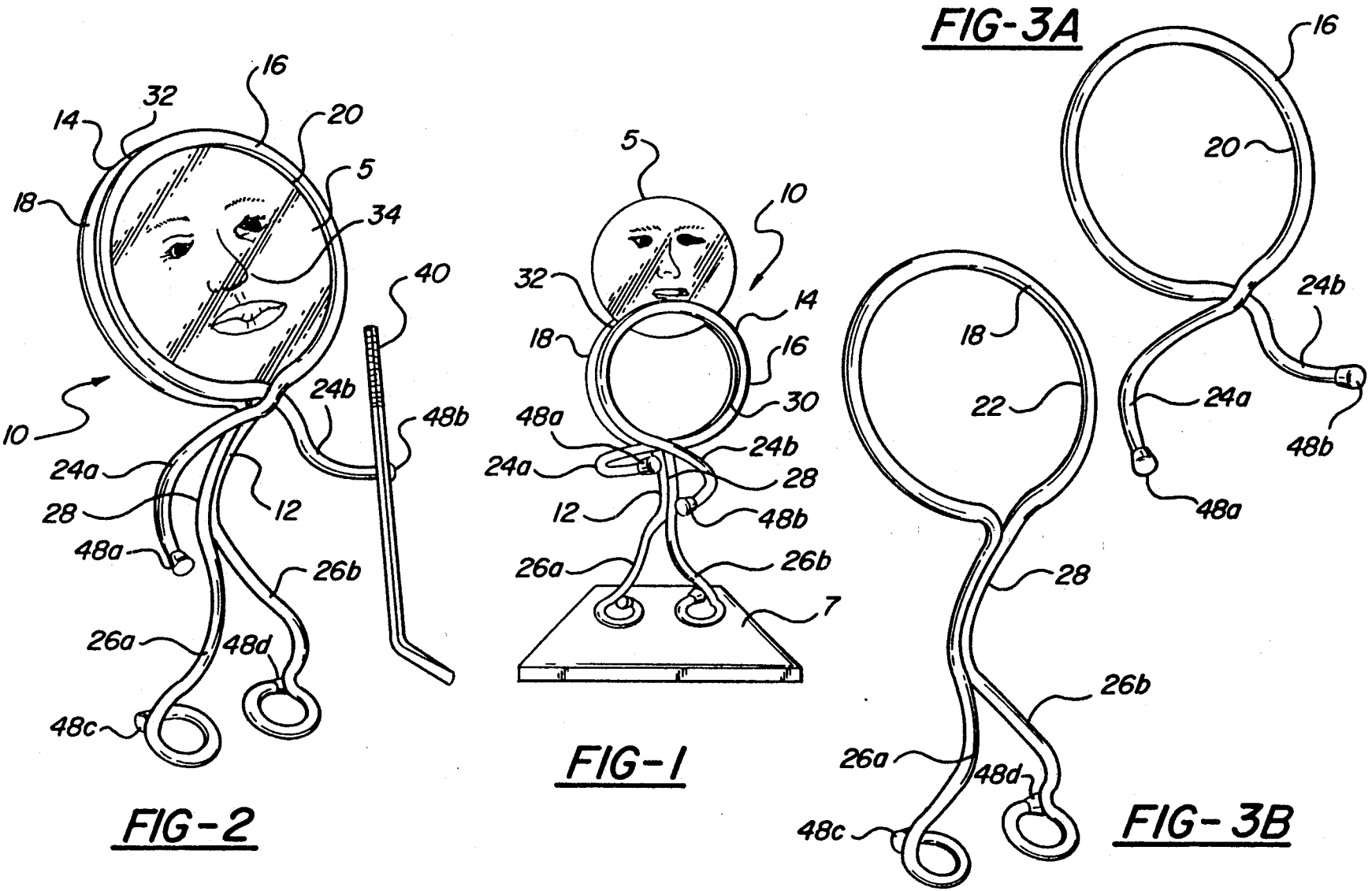
FIG. 1 is a perspective view of an embodiment of a figurine picture frame constructed in the shape of a human in accord with the teachings of the present invention.
FIG. 2 is a perspective view of another embodiment of the present invention.
FIG. 3A is a perspective view of an embodiment of the front section of the head portion in conjunction with the arms of the body portion of the present invention.
FIG. 3B is a perspective view of an embodiment of the back section of the head portion in conjunction with the torso and legs of the body portion of the present invention.

Referring now to the drawings and, in particular, to FIGS. 1 and 2, there is depicted a figurine picture frame 10 in the shape of a stick figure having a body portion 12 and a head portion 14. In general, a picture 5 is inserted into the head portion 14 of the figurine picture frame 10 and supported and displayed therein.

Specifically, FIGS. 1 and 2 show the figurine picture frame 10 configured in the shape of a stick figure human having a body portion 12 comprising a pair of arms *24a,24b* and a pair of legs *26a,26b* stemming from a torso section 28 with a head portion 14 positioned relative to the body portion 12. Although in the preferred embodiments the body portion 12 includes a torso 28, a pair of arms *24a,24b* and a pair of legs *26a,26b*, the figurine 10 does not necessarily require that all of these elements be included in the body portion 12. For example, the body portion 12 may consist solely of a torso 28 with a corresponding pair of arms *24a,24b* positioned relative to the head portion 14. Furthermore, although the preferred embodiments of the figurine picture frame 10 are shaped as stick figures, non-stick figure embodiments of figurines having a picture frame in the head portion 14 are envisioned by and within the scope of the present invention.

The head portion 14 further includes a front section 16 having a peripheral framing member 20 which serves as a picture-viewing opening and a back section 18. The front section 16 lies in substantially a single plane with the back section 18 positioned behind and adjacent to the front section 16 in a substantially parallel plane. Together, the front section 16 and the back section 18 are adapted to engage and display opposite sides of a picture

5 such as a photograph of a person's face. As shown in FIG. 1, in the preferred embodiment, a slot 32 between the front section 16 and the back section 18 of the head portion 14 enables a picture 5 to be inserted in the head portion 14 and displayed therein.

Optionally, the head portion 14 may further include a transparent picture cover 34 to protect the picture 5 from dust and fingerprints while the picture 5 is in the figurine picture frame 10. In the preferred embodiments including the picture insertion slot 32, the cover 34 may be dimensioned to fit through the slot 32. In such instances, the cover 34 may be removed from the figurine picture frame 10 and used as a guide to trace around a desired segment of a picture 5 so that the picture 5 is of the appropriate size to be displayed in the head portion 14 of the frame 10. After the picture 5 has been sized accordingly, the cover 34 and the picture 5 may simultaneously be inserted through the slot 32 with the picture 5 positioned behind and protected by the cover 34.

The back section 18 of the head portion 14 ma also include a peripheral framing member 22 so that both sides of a double-sided picture 5 or two pictures 5 positioned back-to-back may simultaneously be displayed in the head portion 14 of the figurine picture frame 10. In the alternative, the back section 18 of the head portion 14 may be completely enclosed and non-transparent so that the back of the picture 5 is concealed from view when it is positioned in the figurine picture frame 10.

The figurine picture frame 10 may be constructed from a wide variety of materials including metal, wire, glass, and plastic according to methods known in the art. For example, glass or plastic cylindrical tubing may be configured to form either the body portion 12, the front section 16 or the back section 18 of the head 14, or any combination thereof. In the preferred embodiment of the present invention, the figurine picture frame 10 is in the shape of a stick figure having the body 12 and both the front section 16 and the back section 18 of the head 14 formed from one or more lengths of cylindrical tubing. As shown in FIG. 1, a groove 30 is inherently formed between the front section 16 and the back section 18 of the head portion 14 when the front section 16 and the back section 18 are constructed from cylindrical tubing and are in abutment with one another. The groove 30 formed therebetween accepts the peripheral edge of a picture 5 positioned within the head portion 14 and supports the picture 5 for display. The transparent picture cover 34 may also be received and supported by the groove 30.

FIGS. 3A and 3B illustrate how two lengths of cylindrical tubing are configured to form the preferred embodiment of the figurine picture frame 10. FIG. 3A shows the front section 16 of the head portion 14 and the pair of arms **24*a*,24*b* of the body portion 12 formed from one continuous length of cylindrical tubing. The corresponding back section 18 of the head portion 14 and the torso 28 and pair of legs 26*a*,26*b* of the body portion 12, all formed from a second continuous length of cylindrical tubing, are show in FIG. 3B. When the front section 16 of FIG. 3A and the back section 18 of FIG. 3B are abutted in superimposed alignment and affixed to one another using an adhesive or other fastening means such as form-fitted clamps, a figurine picture frame 10** results.

Figure 4A:
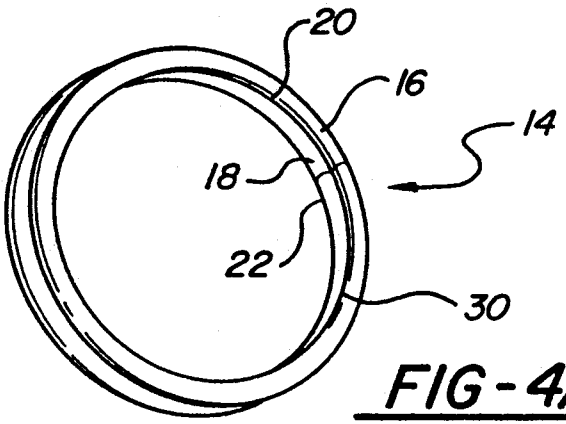
FIG. 4A is a perspective view of an embodiment of the head portion of the present invention.
Figure 4B:
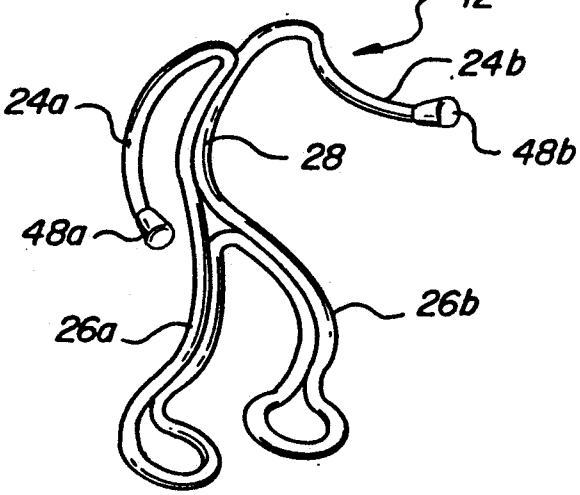
FIG. 4B is a perspective view of an embodiment of the body portion of the present invention.

FIGS. 4A and 4B illustrate an alternative configuration of the figurine picture frame 10 using two separate lengths of cylindrical tubing to form the body portion 12 and the head portion 14. FIG. 4A shows both the front section 16 and the back section 18 of the head portion 14 formed from one continuous length of cylindrical tubing. FIG. 4B shows the entire body portion 12, including a pair of arms **24*a*,24*b*, a pair of legs 26*a*,26*b* and a torso 28, all formed from one piece of cylindrical tubing. The head portion 14 shown in FIG. 4A is then attached to the body portion 12** using an adhesive or other suitable fastening means.

Figure 5:
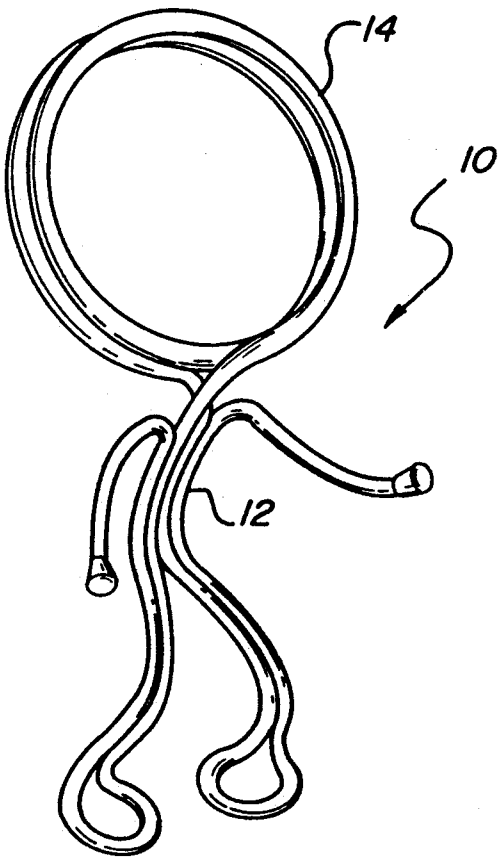
FIG. 5 is a perspective view of an embodiment of the present invention.

Yet another alternative configuration is shown in FIG. 5. In FIG. 5, one length of continuous cylindrical tubing is used to form the complete body and head portions 12,14 of the figurine picture frame 10. It is feasible that each component of the body and head portions 12,14 of the present invention could be formed from separate lengths of cylindrical tubing with all of the components subsequently being positioned and adhered together to form a figurine picture frame 10. However, although within the scope of the present invention, the assembly of multiple components is not the preferred method of manufacture.

In order to enhance the appearance of the figurine picture frame 10 or to represent characteristics of the person or subject of the picture 5 or photograph displayed therein, miniature items may be affixed to the figurine picture frame 10. For example, FIG. 2 shows a human-shaped embodiment of the figurine picture frame 10 that further includes a miniature sports-indicative item 40, a hockey stick, affixed thereto. Accordingly, the display of a picture 5 of a hockey player or a hockey fan In the head portion 14 of the figurine picture frame 10 shown in FIG. 2 would be an ideal use of the present invention.

By way of example but not limitation, other miniature sports-indicative items that may be affixed to the figurine picture frame 10 include a golf club, a tennis racquet, skis and ski poles, a bowling ball, a soccer ball, a baseball bat or glove, a surboard, a fishing pole, a basketball, a football, a coach's whistle, a barbell, or a fishing pole. Miniature items that represent a wide variety of occupations or familial relationships may also be affixed or positioned in relation to the figurine picture frame 10. Again for example but not limitation, a miniature badge and revolver to represent a police officer, a saw and hammer to represent a carpenter, a diaper and pacifier to represent a baby, or a syringe or stethoscope to represent a doctor may optionally be affixed or positioned in relation to the figurine picture frame 10.

In embodiments of the invention formed from lengths of cylindrical tubing, the figurine picture frame 10 may be further enhanced by inserting form-fitted plugs either in or over the free ends of the cylindrical tubing. For example, FIG. 2 shows a pair of plugs **48*a*,48*b* inserted over the ends of the cylindrical tubing configured to represent a pair of arms 24*a*, 24*b*. Thus the plugs 48*a*,48*b* give the appearance of gloves or hands. Likewise, plugs 48*c*,48*d* may be placed in conjunction with the ends of the cylindrical tubing used to form the pair of legs 26*a*,26*b*. If so desired, fluid, beads, glitter, or other novelty items of the appropriate size may be placed within the cylindrical tubing of the figurine picture frame 10 and retained therein by the plugs 48*a*,48*b*,48*c*,48*d***.

Figure 6:
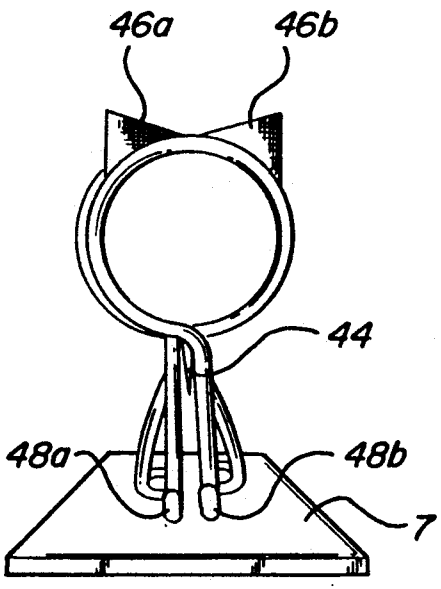
FIG. 6 is a perspective view of an embodiment of the present invention wherein the figurine is configured to represent an animal.

FIG. 6 illustrates a embodiment of the figurine picture frame 10 having a body portion 12 and a head portion 14 configured in the shape of an animal. Specifically, FIG. 6 shows a figurine 10 configured as a cat; however, the figurine 10 may be configured to represent any mammal. In addition, the animal embodiments of the figurine picture frame 10 typically further comprise a pair of ears **46*a*,46*b* connected to and extending from the head portion 14 and a tail 44 connected to and extending from the body portion 12**.

To maintain its upright orientation, the figurine picture frame 10 may be self-supporting or fastened to a base 7 for additional support and stability as shown in FIG. 1 and FIG. 6. In other embodiments of the figurine picture frame 10, the head portion 14 and the body portion 12 may be in substantially the same plane so that the frame 10 may be hung on a wall or other substantially flat surface.

Thus it is apparent that there has been provided, in accordance with the invention, a figurine picture frame 10 configured to represent a mammal having a body portion 12 and a head portion 14 whereby a picture 5 may be displayed and supported within and by the head portion 14. While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as falling within the spirit and broad scope of the claims.

I therefore claim:

1. A combined figurine-picture frame comprising:

a body portion shaped to represent the body of a mammal, said body portion comprising an elongated pair of arms, an elongated pair of legs and a torso, at least a portion of said body portion being formed from cylindrical tubing having at least a first end and a second end;

a head portion supported on the body portion, said head portion including a front section formed from cylindrical tubing, said front section comprising a peripheral framing member lying in substantially a single plane, and head portion further including a back section formed from cylindrical tubing, said back section abutting against said front section so as to form a groove in said frame for receipt of a picture; and a picture insertion slot formed between the back section and the front section of the head portion, the picture insertion slot, and the back section and the front section of the head portion being adapted to engage opposite sides of a picture and thereby support and display said picture relative to said body portion.

2. The combined figurine-picture frame of claim 1 wherein the mammal comprises a human.

3. The combined figurine-picture frame of claim 1 further comprising plugs form-fitted to engage the ends of the body portion length of cylindrical tubing.

4. The combined figurine-picture frame of claim 1 further comprising a tail portion connected to and extending from said body portion.

5. The combined figurine-picture frame of claim 1 further comprising a pair of ears connected to and extending from said head portion.

6. The combined figurine-picture frame of claim 1 further comprising a transparent picture cover dimensioned to fit through said slot, whereby said cover acts as a guide to trace around a desired segment of a picture so that the picture may then be cut to fit through said slot and held and displayed beneath said cover in said frame.

7. The picture frame of claim 1 further comprising a miniature sports-indicative item affixed to said figurine.

8. The picture frame of claim 1 further comprising a miniature occupation-indicative item affixed to said figurine.

9. The combined figurine-picture frame of claim 1 wherein said pair of arms of the body portion and said front section of the head portion are formed by a first continuous length of cylindrical tubing.

10. The combined figurine-picture frame of claim 8 wherein said torso and said pair of legs of the body portion and said back section of the head portion are formed by a second continuous length of cylindrical tubing joined to said first continuous length of cylindrical tubing.

* * * * *